US006123580A

United States Patent [19]

Bendorf et al.

[11] Patent Number: 6,123,580

[45] Date of Patent: Sep. 26, 2000

[54] BOARD LOCK FOR AN ELECTRICAL CONNECTOR

[75] Inventors: Robert Lynn Bendorf, Millerstown; Dirk Ronald Dixon; Robert Thomas Hirsbrunner, both of Hummelstown, all of Pa.

[73] Assignee: The Whitaker Corporation, Wilmington, Del.

[21] Appl. No.: 09/250,773

[22] Filed: Feb. 12, 1999

Related U.S. Application Data

[60] Provisional application No. 60/083,686, Apr. 30, 1998.

[51] Int. Cl.[7] ..... H01R 13/60

[52] U.S. Cl. ..... 439/567; 439/571; 439/329

[58] Field of Search ..... 43/567, 552–555, 43/329, 571, 573, 813, 78, 79

[56] References Cited

U.S. PATENT DOCUMENTS

| | | | |
|---|---|---|---|
| 5,115,375 | 5/1992 | Garay | 439/567 |
| 5,419,713 | 5/1995 | Northey | 439/329 |
| 5,478,257 | 12/1995 | Cachina et al. | 439/567 |
| 5,489,219 | 2/1996 | Fabian | 439/567 |
| 5,520,551 | 5/1996 | Broschard, III | 439/567 |
| 5,613,877 | 3/1997 | Patel et al. | 439/567 |

OTHER PUBLICATIONS

AMP Drawing No. 145283 (Dimensions redacted) Aug. 19, 1997.

AMP Drawing No. 145337 (Dimensions redacted) No date.

AMP Drawing No. 145401 (Dimensions redacted) Aug. 4, 1998.

*Primary Examiner*—Brian Sircus
*Assistant Examiner*—J. F. Duverne
*Attorney, Agent, or Firm*—Michael Aronoff

[57] ABSTRACT

A board lock (50) includes a body (52) having a connector engaging portion (54) and can tilevered beams (56) extending from opposite transverse edges thereof. The inner edges (62) of the beams (56) define a slot (64) therebetween that extends into an enlarged aperture (66) in the center of the body (52). Each of the outer edges (58) of the beams (56) include a protrusion (60) and further include a latching portion (68) at the leading end thereof.

17 Claims, 4 Drawing Sheets

BOARD LOCK FOR AN ELECTRICAL CONNECTOR

This application claims the benefit of U.S. Provisional Application(s) No(s). 60/083,686, filed Apr. 30, 1998.

FIELD OF THE INVENTION

This invention relates to a mounting device for locking or securing components such as electrical connectors to circuit boards.

BACKGROUND OF THE INVENTION

There are numerous ways of securing an electrical connector or the like to a circuit board. For example, the connector may be provided with mounting flanges having bores therethrough for accepting threaded mounting bolts that extend through corresponding through-holes of the circuit board and are secured by nuts or the like on the opposite side of the board. In many instances, however, it is more desirable to have a board mounting or board lock device that does not require mounting flanges on the connector or the use of tools. In addition it is desirable to minimize the space on the circuit board such that the mounting devices for the connector are secured within the cavities of the housing.

Mounting devices or board locks that can be secured within a housing typically have compliant portions that can be compressed upon inserting the board lock into a through-hole of a circuit board and that resile outwardly to engage surfaces within the through-hole. When using board lock devices that engage inner surfaces of a through-hole it is desirable to have a high enough retention force to hold the connector on the board during soldering. A problem associated with board locks having a low insertion and low retention force is that if the circuit board is flexed a sufficient amount, the board lock may move upwardly in the through-hole such that the housing may be lifted off the board. A board lock with a high retention force typically requires a high insertion force, which makes it harder to mount the connectors to the board.

Other board locks may use compliant beams having latch surfaces that engage the lower surface of the circuit board to which the connector is a attached. When using board locks that engage the opposite surface of a circuit board, the beams need to have sufficient length to a accommodate tolerance variations in the thickness of the circuit board so that the board lock will engage the surface if the board is slightly thicker than nominal as well as thinner than nominal. Thus when a connector is mounted to a board that is on the thinner end of the range the connector may not be held securely against the upper surface of the circuit board during the soldering process. The soldered connector thus will not be in the desired position for mating with another connector.

SUMMARY OF THE INVENTION

The present invention is directed to a board lock for holding an electrical connector to a circuit board that eliminates the problems associated with the prior art. The connector includes a housing having a mounting face, a plurality of electrical terminals and at least one board-lock receiving aperture extending into the housing from the mounting face. The board lock includes a planar body having opposed transverse edges with a connector engaging portion extending from one transverse edge thereof and a pair of cantilevered beams extending from the other transverse edge. The cantilevered beams extend to free ends and define an axial slot therebetween. The outer edges of the cantilevered beams include protrusions adapted to engage inner surfaces of an aperture or through-hole of a circuit board to stabilize the position of the connector on the board during the soldering process. At least one of the outer edges of the beams include an outwardly directed latching portion proximate the free end thereof and adapted to engage an under side of a circuit board when the connector is fully mounted to the board. Upon inserting the board lock into aperture of said housing, the beams in the corresponding board aperture and fully mounting the connector on the board, the protrusions on the beams stabilize the connector on the board during soldering of the terminals to respective conductive areas on the board. The at least one latch provides a positive retention force against the under surface of the board to assure the connector remains on the board if the board warps or is flexed during use. The latches provide a positive force for retaining the connector to the circuit board, thereby preventing the housing from being lifted from the board. In one embodiment the outer surface of the cantilevered beams include gently tapered protrusions. In another embodiment of the invention the outer surface of the beams include more sharply defined protrusions.

Additionally the body of the board lock may include an enlarged opening in the body portion that extends into the slot between the beams. This increases the length of the beams to provide more flexibilabilaty to the beams and to distribute the stress along the length of the beams. The greater spring capability means that the insertion force required is less than that of a board lock having shorter beams.

In a further embodiment of the invention the latches on the beams are located at different distances from the mounting face of the connector housing. The latch closer to the housing will engage the under surface of a circuit board that is thinner than the nominal thickness and the other latch will be further below the board. When a circuit board having a thickness that is nominal or slightly thicker than nominal is used, the latch closer to the housing mounting face will remain in the through-hole of the board and the other latch will engage the under surface of the thicker board.

Embodiments of the invention will now be described by way of example with reference to the accompanying drawings.

DETAILED DESCRIPTION OF AN EMBODIMENT OF THE INVENTION

Figure 1:
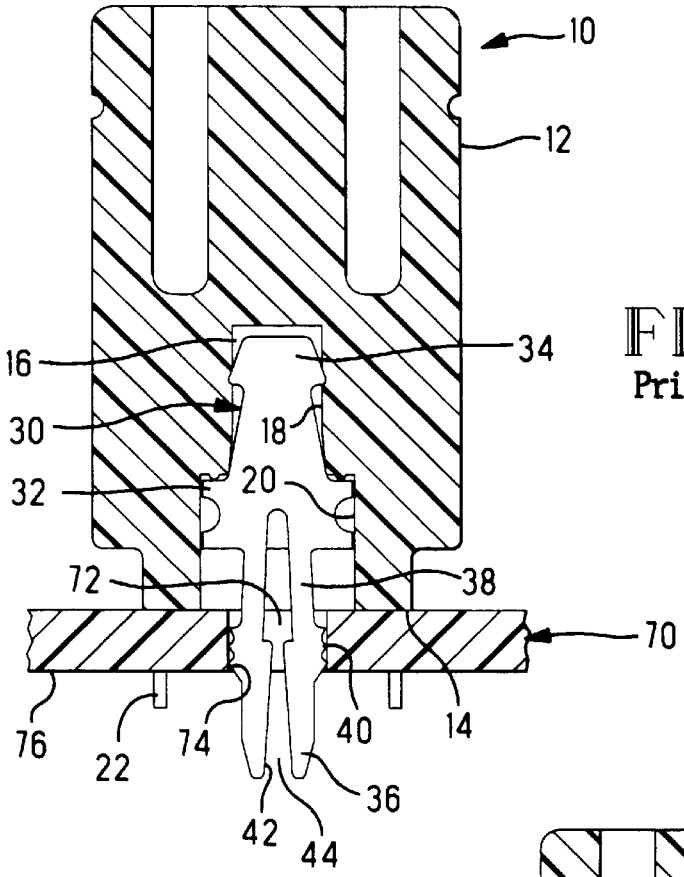
FIG. 1 Prior Art
FIG. 1 is a cross-sectional view of a connector using a prior art board lock device.

For purposes of illustrating the invention the prior art board lock and the present invention will be described with respect to a connector 10 having a housing 12 with a board mounting face 14. Housing 12 includes a board locking receiving cavity 16 having a narrower portion 18 extending into the housing 12 and a wider portion 20 proximate the board mounting face 14. Although only one board lock is illustrated in the FIGS. 1–3, it is to be understood that each connector typically will have a board lock proximate each end thereof and furthermore longer connectors will have additional board locks intermediate the ends thereof.

Referring first to FIG. 1, prior art board lock 30 includes a body 32 having a connector engaging portion 34 extending outwardly from a transverse body side and a pair of cantilevered beams 36 extending outwardly in the opposite direction from the other transverse side of the body 32. The cantilevered beams 36 include outer surfaces 38 having outwardly directed barbs 40 adapted to engage surfaces 74 of a board lock receiving through-hole 72 in circuit board 70. The inner edges of 42 of the cantilevered beams 36 define a slot 44 therebetween. Upon inserting the board lock 30 into the through-hole 72 the cantilevered beams 36 are forced to resile inwardly, closing slot 44. The resultant force generated outwardly by the beams 36 cause the barbs 40 to exert force against the surfaces 74 of through-hole 72. As can be seen in FIG. 1, the barbs 40 exert force against the through-hole 72 to hold the connector 10 to board 70 during the soldering process. If the circuit board 70, however, is flexed or becomes sufficiently warped during operation the retention of the board locks can be overpowered resulting in upward movement of the board locks in the respective through-holes such that the barbs 40 no longer engage surfaces 74. The connector housing 12 may be lifted above the board 70.

Figure 2:
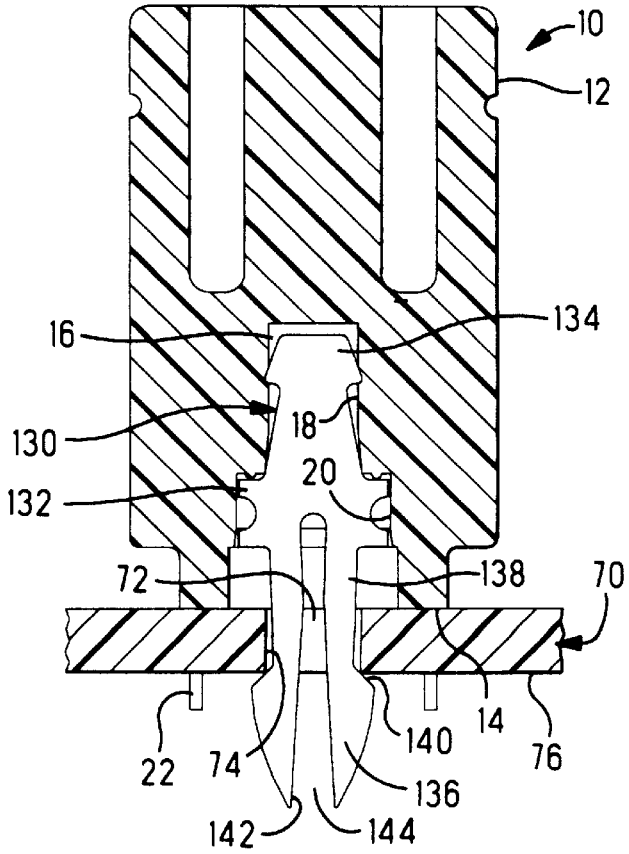
FIG. 2 Prior Art
FIG. 2 is a cross-sectional view of a connector using another prior art board retention device.

FIG. 2 shows another prior art embodiment 130 having a body 132 with a connector engaging portion 134 extending from a transverse body side and a pair of cantilevered beams 136 extending from the other transverse side of the body. In this embodiment the outer surface 138 of each of the cantilevered beams includes an outwardly directed latch surface 140 that is dimensioned to engage the lower surface 76 of the board 70 upon mounting the connector 10 to the circuit board 70. The inner surfaces of the cantilevered beams 142 define a slot 144 therebetween. As can be seen in FIG. 2, if the thickness of the circuit board 70 is at the lower end of the tolerance range, the surface 140 can be below the actual surface 76 thus prior to soldering the connector to the board the connector can be lifted slightly above the board rather than being held securely to the board as with the embodiment shown in FIG. 1. In embodiment 130, the cantilevered beams 136 are forced inwardly as the outwardly directed edges of the cantilevered beams 136 are inserted into the through-hole 72. The beams 136 resile outwardly when the latch portions 139 extend below the bottom of the circuit board 70.

Figure 3:
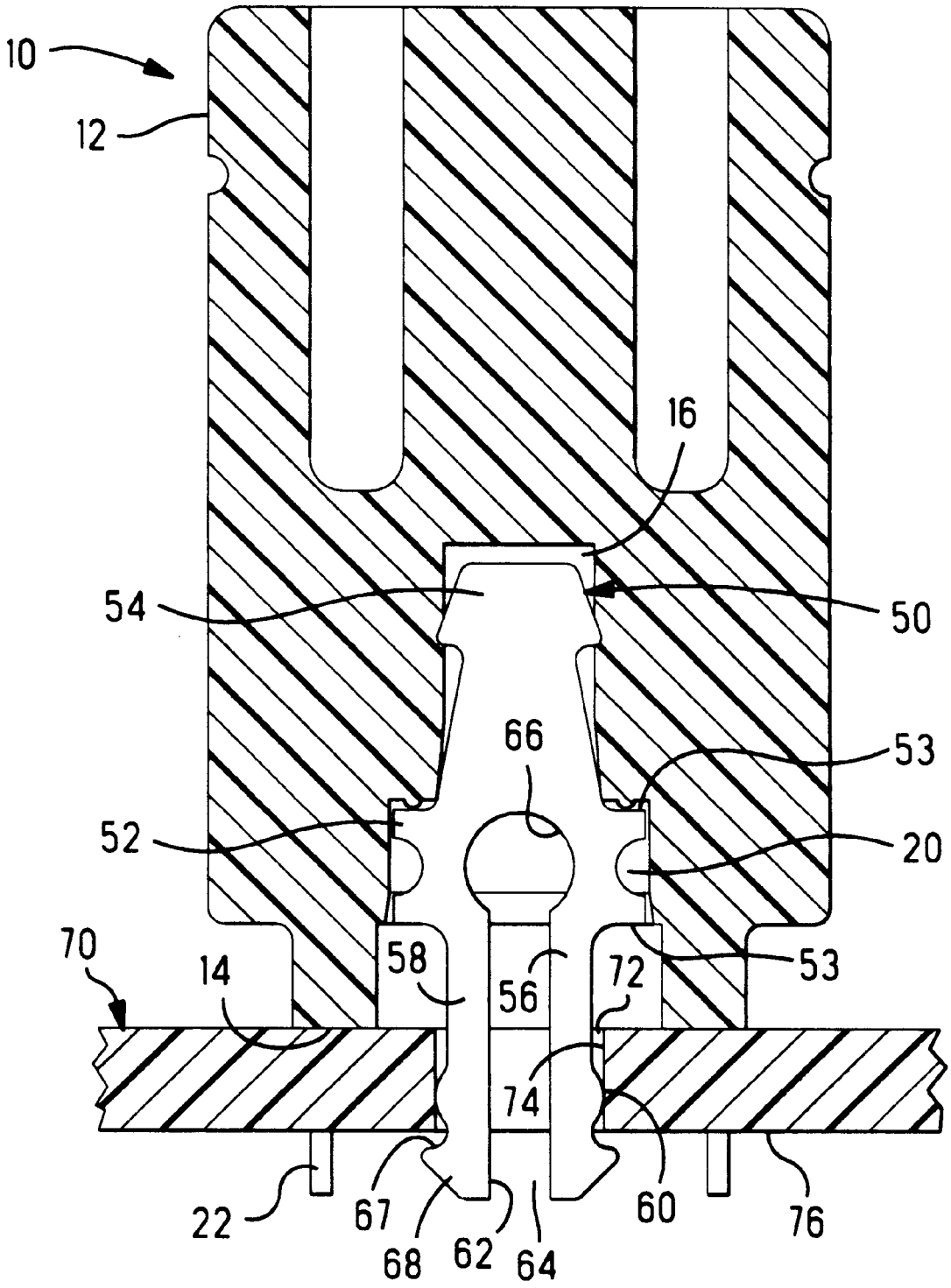
FIG. 3 is a cross-sectional view of a connector having a board lock made in accordance with the present invention.

FIG. 3 discloses a board lock 50 made in accordance with the invention. Board lock 50 includes a body 52 having a connector-engaging portion 54 extending from a transverse edge 53 of body 52 and cantilevered beams 56 extending from an opposite transverse edge 53. The inner edges 62 of the beams 56 define a slot 64 therebetween that extends into an enlarged aperture 66 in the center of the body 52. Each of the outer edges 58 of the beams 56 include at least one curved protrusion 60 and further include a latching portion 68 at the leading end thereof. As can be seen in FIG. 3, when the connector 10 is mounted to the circuit board 70 the curved surfaces 60 engage the inner surfaces 74 of the through-hole 72 while surfaces 67 of the latching portions 68 are below the lower surface of the board. The protrusions 60 exert sufficient force to stabilize the connector 10 during soldering wherein the soldered terminals 22 are secured to the circuit board 70. When the circuit board 70 is flexed, the connector housing 12 can move only a slight distance before the respective latching surfaces 67 engage the under surface 76 of the board 70. Thus, housing 12 remains on the board 70 even when the board has been flexed or warped.

A further feature of the board lock 50 of the present invention is that enlarged aperture 66 in the body 52 extends the length of the beams 56. Thus, beams 56 are more flexible than those of the prior art and require less insertion force when the connector is mounted to the circuit board.

Figure 4:
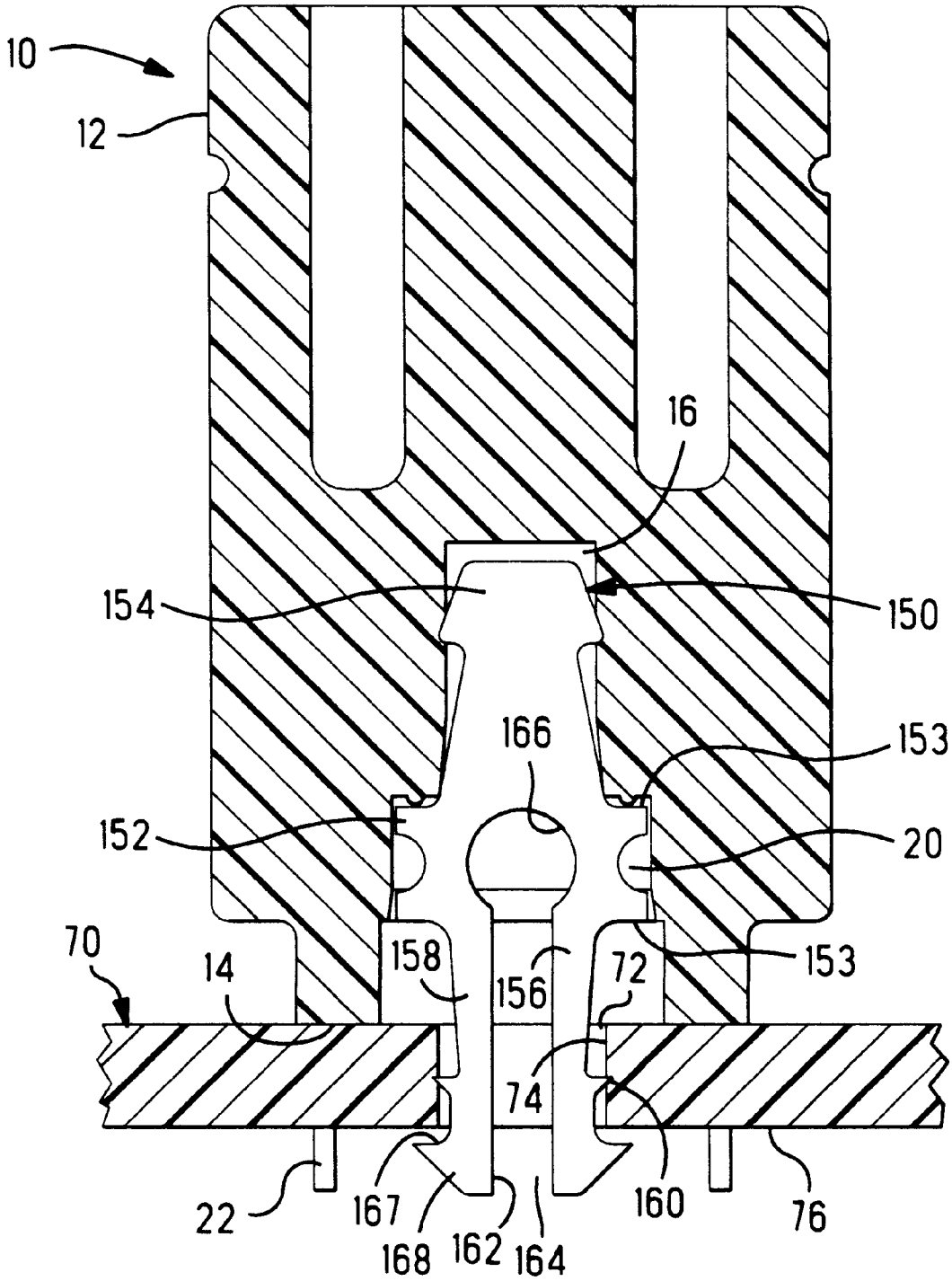
FIG. 4 is a cross-sectional view of a connector having an alternative embodiment of a board lock made in accordance with the present invention.

FIG. 4 illustrates an alternative embodiment 150 of the board lock of the present invention. Board 150 includes a body 152 having a connector-engaging portion 154 extending from a transverse edge 153 of body 152 and cantilevered beams 156 extending from an opposite transverse edge. The inner edges 162 of the beams 156 define a slot 164 therebetween that extends into an enlarged aperture 166 in the center of the body 152. the outer edges 158 of the beams 156 include more sharply defined protrusions 160 than board lock embodiment 50. Each beam 156 of board lock 150 further includes a latching portion 168 at the leading end thereof. As can be seen in FIG. 4, when the connector 10 is mounted to the circuit board 70 the sharp surfaces 160 engage the inner surfaces 74 of the through-hole 72 while surfaces 167 of latching portions 168 are below the lower surface of the board. The protrusions 160 exert a greater force than the rounded protrusions 60 of embodiment 50 to stabilize the connector 10 during soldering wherein the soldered terminals 22 are secured to the circuit board 70. Board lock 150 includes the enlarged aperture 166, which functions in the manner described above.

Figure 5:
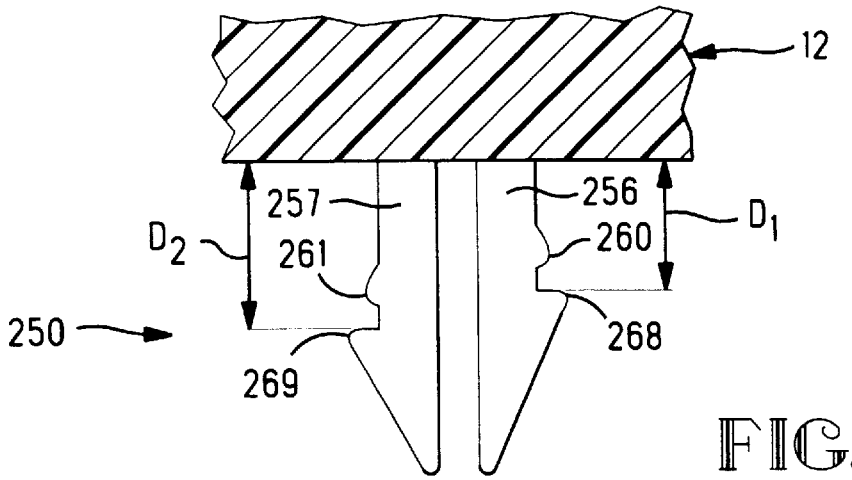
FIG. 5 is a fragmentary enlarged view of a further alternative embodiment of a board lock made in accordance with the present invention.
Figure 6:
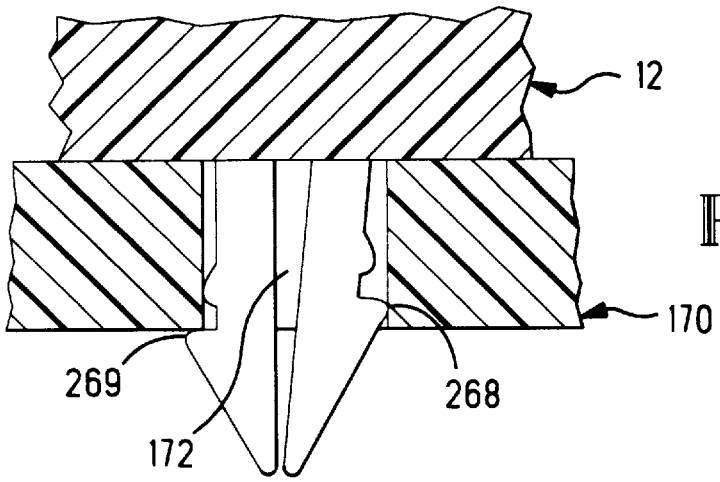
FIG. 6 is a cross-sectional view of a fragmentary portion of a connector having the board lock of FIG. 5 mounted in a circuit board.
Figure 7:
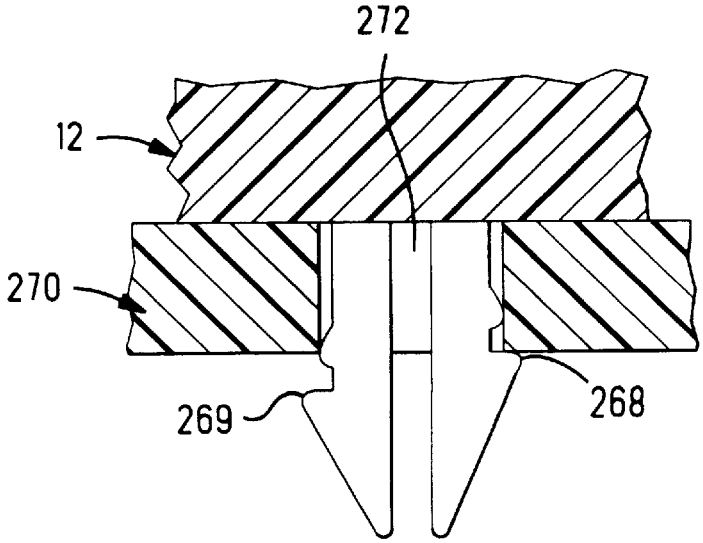
FIG. 7 is a view similar to that of FIG. 6 illustrating a connector having the board lock of FIG. 5 mounted in a thinner circuit board.

FIGS. 5 through 7 illustrate the board-retention portions of another embodiment 250 of the invention having cantilevered beams 256, 257 with respective protrusions 260, 261 and latches 268, 269. As can be seen in FIG. 5, the latches 267, 269 are offset from one another, the distance d, from latch 268 to housing 12 being less than the distance $d_2$ from latch 269 to housing 12. By locating the two latches at slightly different distances from the bottom of the housing the board lock can accommodate tolerance variations in the thickness of the board. The latch 269 closer to the housing 12 will engage the under surface of a board that is thinner than the nominal thickness and latch 267 is located to engage a board of nominal or slightly greater than nominal thickness. FIG. 6 illustrates a board lock 250 inserted in through-hole 172 in a board 170 at the thicker end of the range wherein latch 269 engages the lower board surface and latch 268 remains in through-hole 172. In FIG. 7, board lock 250 is inserted into through-hole 272 of board 270 that is at the thinner end of the range. In this instance, latch 268 engages the lower board surface and latch 269 is spaced from the board 270. Board lock 250, therefore, minimizes the potential gap between the latch and the board by providing a latching surface for circuit boards at both ends of the tolerance range.

The board locks 50, 150 and 250 of the present invention overcome the problems associated with flexing of the circuit board as well as the problems of accurately holding the connector in position of the board during the soldering process. The design of the elongated beams allows the connector to be inserted with less force than the prior art board locks.

It is thought that the board lock of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. A board lock for holding an electrical connector to a circuit board, comprising:

an essentially planar body having a first and second end, said first end having a connector engaging portion, said second end having two cantilever beams, wherein said cantilever beams define an axial slot therebetween and each of said cantilever beams has an outer edge opposite of said slot and comprises at least one protrusion extending laterally from said outer edge, and at least one of said cantilever beams further comprises a latching portion extending laterally from the outer edge of said at least one cantilever beam such that said latching portion extends beyond said at least one protrusion on said at least one cantilever beam when said board lock is engaged with a circuit board; and wherein said protrusions are adapted to engage side wall surfaces of an aperture of a circuit board and said latching portion is adapted to engage an under side of said circuit board to prevent movement of a connector relative to said circuit board when said board lock is engaged with said circuit board.

2. The board lock of claim 1 wherein each of said cantilever beams comprises a latching portion extending laterally from its outer edge.

3. The board lock of claim 2 wherein the latching portion on one of said cantilever beams extends from a location on said cantilever beam which is closer to said body than the location from which the latching portion on the other cantilever beam extends.

4. The board lock of claim 1 wherein each of said protrusions is blunt.

5. The board lock of claim 1 wherein each of said protrusions is pointy.

6. The board lock of claim 1 wherein said body includes an enlarged aperture in communication with said axial slot between said pair of beams, thereby increasing the length and flexibility of said beams and reducing the insertion force required to mount the connector on a board.

7. The board lock of claim 6 wherein each of said cantilever beams comprises a latching portion extending laterally from its outer edge.

8. The board lock of claim 7 wherein the latching portion on one of said cantilever beams extends from a location on said cantilever beam which is closer to said body than the location from which the latching portion on the other cantilever beam extends.

9. The board lock of claim 6 wherein each of said protrusions is blunt.

10. The board lock of claim 6 wherein each of said protrusions is pointy.

11. An electrical connector for mounting to a circuit board, comprising:

a housing having a mounting face, said housing defining at least one board lock-receiving aperture extending into said housing from said mounting face;

a board lock disposed within said board-lock receiving aperture, said board lock comprising:

an essentially planar body having a first and second end, said first end having a connector engaging portion, said second end having two cantilever beams, wherein said cantilever beams define an axial slot therebetween and each of said cantilever beams has an outer edge opposite of said slot and comprises at least one protrusion extending laterally from said outer edge, and at least one of said cantilever beams further comprises a latching portion extending laterally from the outer edge of said at least one cantilever beam such that said latching portion extends beyond said at least one protrusion on said at least one cantilever beam when said board lock is engaged with a circuit board; and wherein said protrusions are adapted to engage side wall surfaces of an aperture of a circuit board and said latching portion is adapted to engage an under side of said circuit board to prevent movement of a connector relative to said circuit board when said board lock is engaged with said circuit board.

12. The board lock of claim 11 wherein each of said cantilever beams comprises a latching portion extending laterally from its outer edge.

13. The board lock of claim 12 wherein the latching portion on one of said cantilever beams extends from a location on said cantilever beam which is closer to said body than the location from which the latching portion of the other cantilever beam extends.

14. The board lock of claim 13 wherein said body includes an enlarged aperture in communication with said axial slot between said pair of beams, thereby increasing the length and flexibility of said beams and reducing the insertion force required to mount the connector on a board.

15. The board lock of claim 14 wherein each of said protrusions is blunt.

16. The board lock of claim 14 wherein each of said protrusions is pointy.

17. An electrical connector system, comprising:

a circuit board;

an electrical connector;

an essentially planar body having a first and second end, said first end having a connector engaging portion, said second end having two cantilever beams, wherein said cantilever beams define an axial slot therebetween and each of said cantilever beams has an outer edge opposite of said slot and comprises at least one protrusion extending laterally from said outer edge, and at least one of said cantilever beams farther comprises a latching portion extending laterally from the outer edge of said at least one cantilever beam such that said latching portion extends beyond said at least one protrusion on said at least one cantilever beam when said board lock is engaged with a circuit board; and wherein said protrusions are adapted to engage side wall surfaces of an aperture of a circuit board and said latching portion is adapted to engage an under side of said circuit board to prevent movement of a connector relative to said circuit board when said board lock is engaged with said circuit board.

* * * * *